US006436006B1

(12) United States Patent
Zemlyakov et al.

(10) Patent No.: US 6,436,006 B1
(45) Date of Patent: Aug. 20, 2002

(54) HIGH PRECISION RESISTANCE DEVICE FOR AN EXERCISE

(76) Inventors: Vladimir Zemlyakov, 536 Hadley W. Drive, Haverhill, MA (US) 01832; Patrick McDonough, 5 Gaslight La., Kensington, NH (US) 03827

( * ) Notice: Subject to any disclaimer, the term of this patent is extended or adjusted under 35 U.S.C. 154(b) by 0 days.

(21) Appl. No.: 09/226,855

(22) Filed: Jan. 7, 1999

(51) Int. Cl.[7] ..... A63B 21/008
(52) U.S. Cl. ..... 482/51; 482/112
(58) Field of Search ..... 482/111, 112, 482/51, 70, 71, 130, 110, 113, 52

(56) References Cited

U.S. PATENT DOCUMENTS 3,103,357 A * 9/1963 Berne ..... 482/112
3,784,194 A * 1/1974 Perrine ..... 482/112
5,529,552 A * 6/1996 Biedermann et al. ..... 482/111
5,643,157 A * 7/1997 Seliber ..... 482/112

* cited by examiner

*Primary Examiner*—Stephen R. Crow

(57) ABSTRACT

Disclosed is a high precision resistance device that allows a user to set and hold exact load amount and pattern of loading in exercise machine. The one embodiment of the device includes a hydraulic cylinder having a piston and two valves, two driving members, a driven member, a cam, and a connecting rod. Each valve can change flow section area in the hydraulic cylinder. One valve manually sets an original level of an exercise load. Second valve is adjusted by the cam to maintain a predetermined pattern of the exercise load. The cam can be easily change for another one having different shape and providing accordingly the predetermined pattern of the exercise load, that is pattern of loading applied to a user's muscular system in operation. Driving members are adapted to receive a plurality of exercise accessories. The resistance device can be installed in actually any conventional fitness machine to transform it into precise equipment for medical research, therapy, and rehabilitation. It also can be used as a stand-alone compact and inexpensive unit with many possibilities to perform both medical and fitness exercises to predetermined programs.

10 Claims, 11 Drawing Sheets

HIGH PRECISION RESISTANCE DEVICE FOR AN EXERCISE

BACKGROUND OF THE INVENTION

1. Field of the Invention

The present invention relates generally to an exercise and testing apparatus of human motion activity. More particularly it relates to a resistance creating means applied to a person muscular system during an exercise, with a precision and uniformity that provide rehabilitation, diagnostic, therapeutic and/or fitness process exactly as predetermined for the best result in different modes of operation, such as isometric, isotonic, and isokinetic.

2. Description of the Related Art

Conventional equipment that has been developed for a person to improve his/her muscular system more efficiently has also been used for rehabilitation and therapeutic applications. This is caused by relatively low cost of exercise machines versus special equipment.

However, conventional exercise machines do not meet requirements for medical applications. The main reason for the nonconformance is in the mode of load and inertia. The mechanical and electromechanical resistance means of the machines do not provide exact amount of a predetermined load and its application mode. The resistance force created by a flywheel or weights has inertia.

It is exact predetermined load with no inertia that the most important part of diagnostic and rehabilitation processes. For example, to elaborate an effective rehabilitation program after a heart attack, electrophisiological method can be effectively used only with exact amount of muscular work in isometric and isotonic mode. In neurology, any deviation of human motion activity from normal pattern can reveal some pathology. But to research the pattern of an individual motion, the exact predetermined amount of load and mode of its application is needed.

U.S. Pat. No. 5,643,157 to Seliber discloses a device wherein the resistance to motion of an exercise link is a function of the speed of a variable speed rotary driving means. The speed of the rotary driving means is controlled by the user selected value before exercise begins. The resistance to motion stays constant during exercise if the user does not change the resistance. It is well known that the magnitude of muscle force depends on the user's joint angle. Therefore, muscle force will change according to alteration of the joint angles that, are applied in physical therapy. But, very often, contemporary rehabilitation requires that muscle force be either constant or alter for a predetermined force curve during the joint movement cycle. The seliber's device does not meet these requirements. Also, the resistance to motion of an exercise link is a function of the direction of the link; the fluid coupling acts as a clutch when the "heavy negative" training is used or as a brake during "power" exercise. Thus, the resistance to motion in this device is time/speed dependent and the sources of the resistance to motion are different for different directions of the joint movement that limits muscle exercise. And finally, the Seliber's device requires electrical power that limits its portable application. In older U.S. Pat. No. 3,103,357 to Berne the exercise resistance is created by a friction clutch that is operated by hydraulic cylinder and piston means. The fluid pressure of the hydraulic cylinder is measured as frictional resistance. It is well known that friction force may vary depending on surface conditions, grease, humidity, temperature, vibration, difference between coefficients of static and dynamic friction, and cannot be considered a constant magnitude. Although the fluid pressure can be mounted and measured with high accuracy, the exercise resistance will change depending on the frictional force. In U.S. Pat. No. 3,784,194 to Perrine the resistance force is created by input members on opposite ends of the actuator—either a rotary hydraulic actuator or a conventional cylinder. The stroke of input members is restricted to either the angle of rotation or the length of the actuator. Thus, some modes of exercises that need a long stroke of a piston are impossible, for example, bicycle type exercise.

Even special systems for rehabilitation purpose, occupational therapy, and orthopedic evaluation focus on patient feedback data with given isokinetic speed and isokinetic torque too much more extent than on load mode. Simple and inexpensive equipment to provide the predetermined load is needed.

Simple resistance means to provide non-inertial, non-restrictive in length of motion, and relatively constant load during an exercise are known (see, for example, U.S. Pat. No. 5,529,552). In the known means the resistance force is created by a hydraulic cylinder with manually adjustable flow section area. A piston of the cylinder is connected by a connecting rod with a driven member engaged with a driving member having a cable; whereby a user exercises by pulling the cable against the resistive force generated by said cylinder.

The known resistance devises, as mentioned above, can provide relatively constant load to a muscular system during an exercise, but some limits of accuracy still having place. Those limits are caused by variable deviation of a connecting rod longitudinal axis from stroke direction of the piston during an exercise. The longer the connecting rod the smaller is the deviation and, consequently, the higher accuracy. But one can not elongate the connecting rod infinitely. So, some inaccuracy still remains and impairs results of medical applications.

One object of the present invention is to develop a simple and inexpensive correction means for load stabilization that can be used in combination with known resistance means.

Another object of the present invention is to develop means for predetermined load pattern to meet requirements of medical research both in load applied to a person muscular system and a feedback data acquisition process.

Another object of the present invention is to develop a high accuracy resistance device for an exercise machine that can be used for rehabilitation, therapeutic, and diagnostic purposes.

Another object of the present invention is to develop a compact and easy serviced resistance device that can provide precise amount of load.

BRIEF SUMMARY OF THE INVENTION

In main embodiment of the present invention the resistance device for an exercise machine comprises a driven member to convey a person's applied exercise load to a resistance means consisting of a hydraulic cylinder having front and rear ends and two separate channels joining these front and rear ends, a piston, a connecting rod to engage the piston with the driven member and transmit force in either direction between the piston and the driven member, and a correction means to maintain a predetermined exercise load and offset load instability that is caused by an angle variation between the connecting rod longitudinal axis and the piston stroke direction. The hydraulic cylinder and both channels are filled with incompressible fluid. The first channel has a first valve that can be adjusted manually by an adjustment means to set an original magnitude of the exercise load. The second channel has a second valve that is adjusted by the correction means. The correction means comprises a cam is coaxial with and secured to the driven member and permanently engaged with the second valve. The cam is secured to the driven member in interchangeable manner and shaped accordingly to a predetermined pattern of the exercise load.

The main embodiment of the present invention, also, comprises an immovable driving member and a movable driving member. The immovable driving member is permanently engaged with the driven member. The immovable driving member has a shaft that is coaxial with and secured to the driven member. The shaft has two free ends to receive and attach any exercise accessories for rotation mode exercise such as bicycle, ski, stairstep, and so on and/or "push-pull" fashion of an exercise. The movable driving member may be engaged with the driven member by an engaging means. The movable driving member has a drum that is coaxial with and secured thereto. The drum has an outside peripheral groove to receive and store a cable that has a free end. The free end is adapted to receive and attach different exercise accessories for pulling mode exercise. The movable driving member is engaged with the driven member during pulling mode exercise that causes unwinding of the cable from the cable drum. In free condition the movable driving member is disengaged with the driven member.

Thus, any pattern of application and precise amount of the exercise load can be applied to a person's muscular system just by installing the cam having an appropriate periphery. The cam is a compact part to adjust a valve position in a hydraulic cylinder. It is also a simple and inexpensive flat part that can be easily made with any conventional machine tool using a template. By adapting any conventional exercise machine for the resistance device in accordance with the present invention, one can turn simple and inexpensive fitness equipment into precise medical multi-purpose tool.

BRIEF DESCRIPTION OF THE SEVERAL VIEWS OF THE DRAWINGS

The following detailed description of the present invention will be better understood with reference to the accompanying drawings in which.

DETAILED DESCRIPTION OF THE INVENTION

Figure 1:
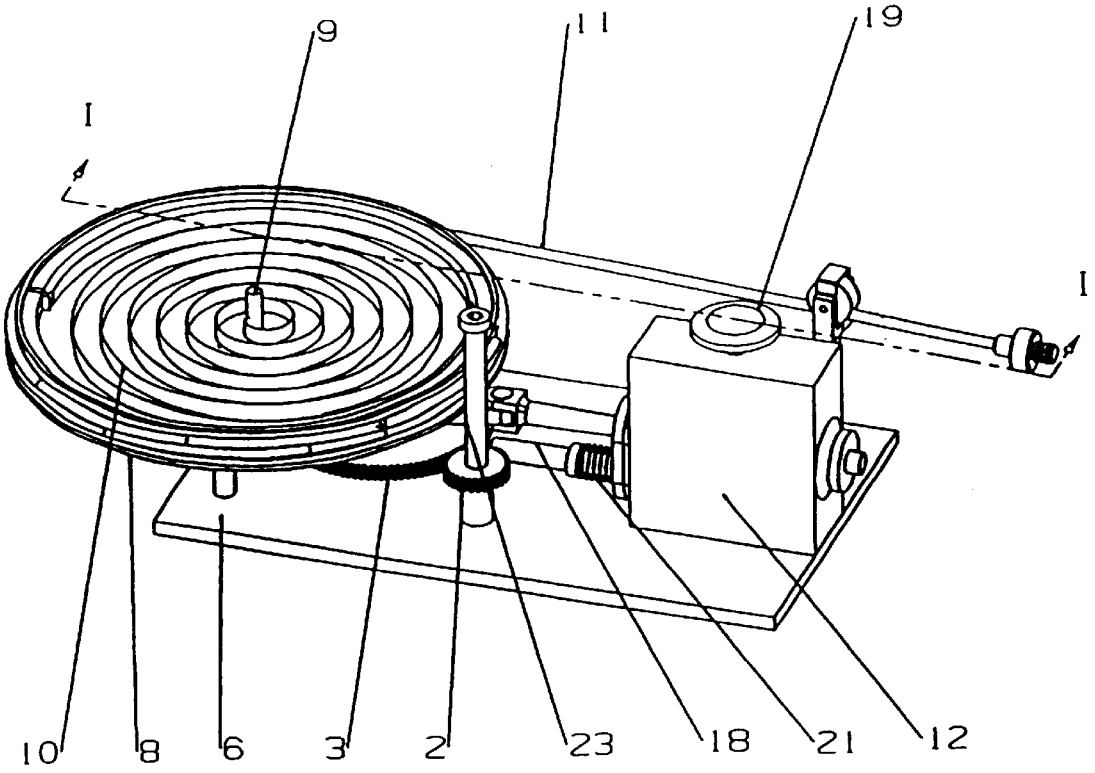
FIG. 1 is a perspective view of one embodiment of the resistance device according to the present invention.

Referring to FIGS. 1–6 wherein one embodiment of the resistance device according to the present invention is shown. In this embodiment, the resistance device comprises a movable driving member 1, an immovable driving member 2 that is permanently engaged with a driven member 3, a resistance means (to be described), and a correction means (to be describe) (see FIG. 3). Members 1, 2, and 3 have circumferential tooth portions for reliable engagement to each other. To connect/disconnect the member 1 with/from the member 3, there is an engaging means. The engaging means comprises an arm 4, a fulcrum 5, and a spring 7. The fulcrum 5 is installed on a frame 6. The arm 4 can be rotated around a fulcrum 5 by either an exercising person or a spring 7. The spring 7 is located on opposite ends of the arm 4 regarding the fulcrum 5. One end of the spring 7 is fixed to the arm 4 while a second end of the spring 7 is fixed to the frame 6. The member 3 is rotatably mounted on the frame 6 through an axis of rotation.

Figure 2:
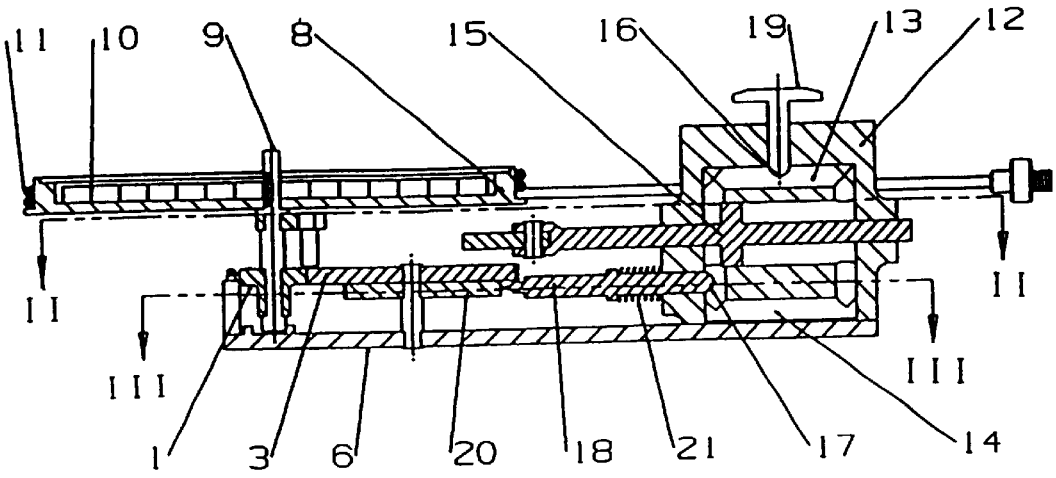
FIG. 2 is a cross-section view of the resistance device along line I—I of FIG. 1.

The member 1 is coaxial with and secured to a drum 8 and can be freely rotated around an axle 9 (see FIG. 2). The axle 9 is fixed to the arm 4 and located between the fulcrum 5 and the spring 7. The drum 8 has an internal cavity in which is located a recoil spring 10. One end of the spring 10 is attached to the axle 9 while a second end of the spring 10 is fixed to the drum 8. Also, the drum 8 has an outside peripheral groove to receive and store a cable 11 that is being wound around the groove. One end of the cable 11 is fixed to the drum 8 while a second end of the cable 11 is free. The free end of the cable 11 is adapted to receive and attach pulling exercise accessories interchangeably for pulling mode exercise as illustrated by FIGS. 6, 11, 12, 16, 17, and 18. The pulling exercise accessories can consist of plurality belts and grips 30.

The member 2 is coaxial with and secured to a shaft 23 that is rotatably installed in the frame 6 (see FIG. 1). Each end of the shaft 23 is adapted to receive and attach rotation exercise accessories interchangeably for rotation mode exercise as illustrated by FIGS. 6, 13, 14, 15, 19, 20, and 21. The rotation exercise accessories can consist of a second drum 24, plurality of levers 25, and a second cable 26.

The resistance means comprising a hydraulic cylinder 12 having a first channel 13, a second channel 14, and a piston 15 that is moved in the cylinder 12 in between it's a front and a rear ends (see FIG. 2). The cylinder 12 is secured to the frame 6. The hydraulic cylinder 12 and channels 13 and 14 are filled with incompressible fluid. Both channel 13 and channel 14 separately connect the front and the rear ends of the cylinder 12, and they are never blocked by the piston 15.

Figure 3:
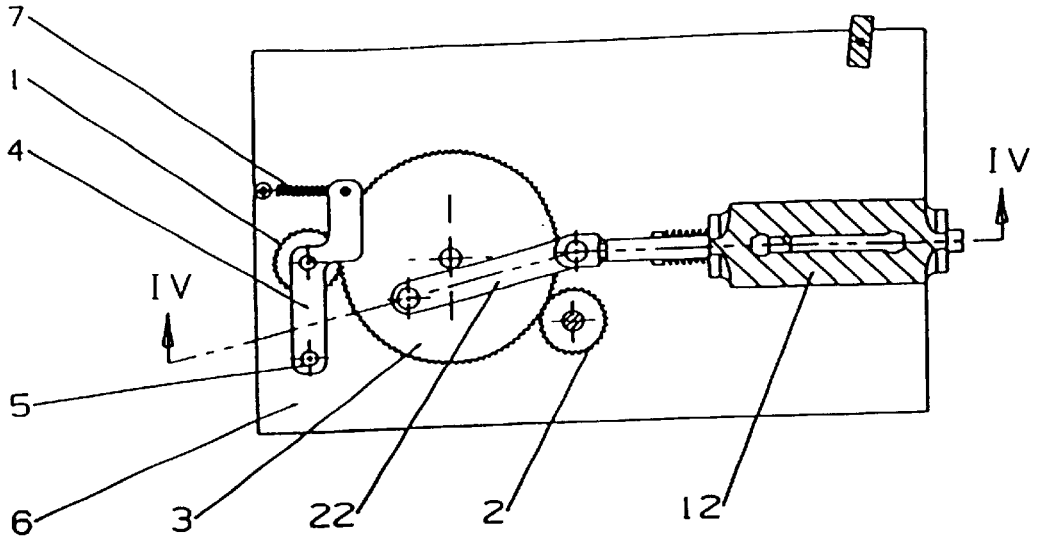
FIG. 3 is a cross section view of the resistance device along line II—II of FIG. 2.
Figure 4:
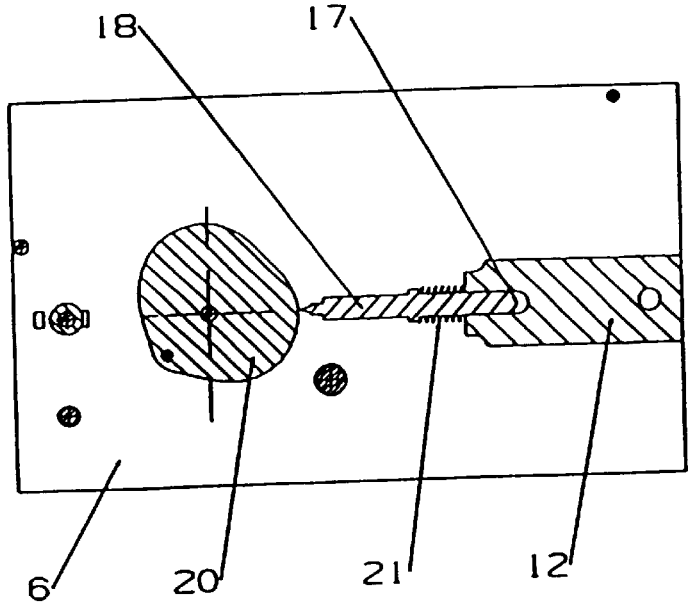
FIG. 4 is a cross section view of the resistance device along line III—III of FIG. 2.
Figure 5:
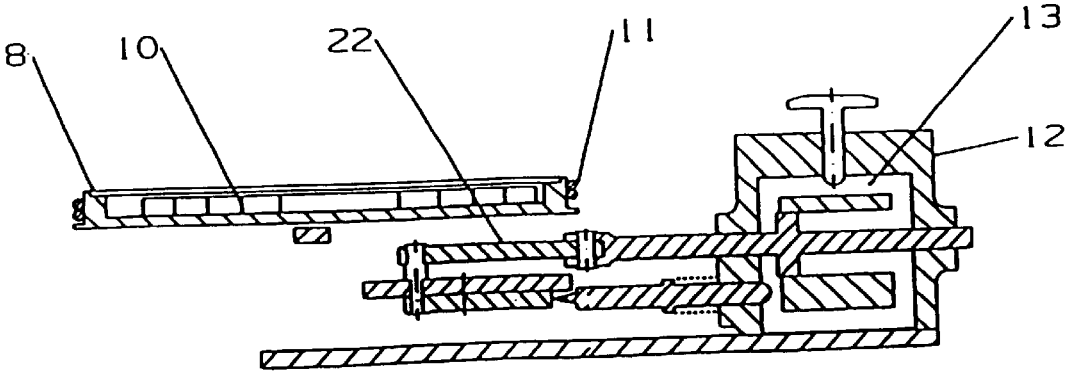
FIG. 5 is a cross section view of the resistance device along line IV—IV of FIG. 3.
Figure 6:
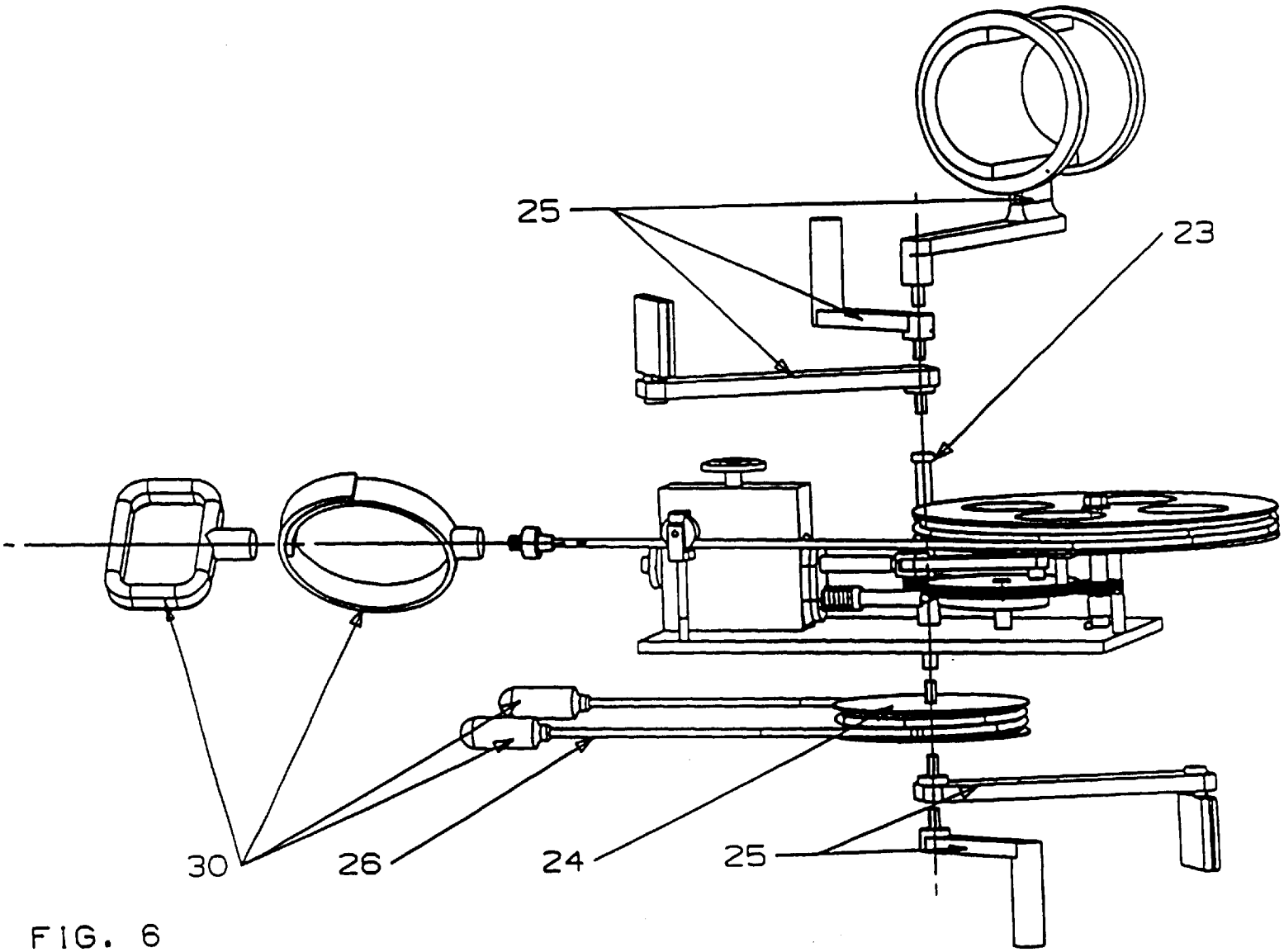
FIG. 6 is a perspective view of one embodiment of the resistance device according to the present invention showing an accommodation of a plurality of exercise accessories for rotation and pulling mode exercise.
Figure 7:
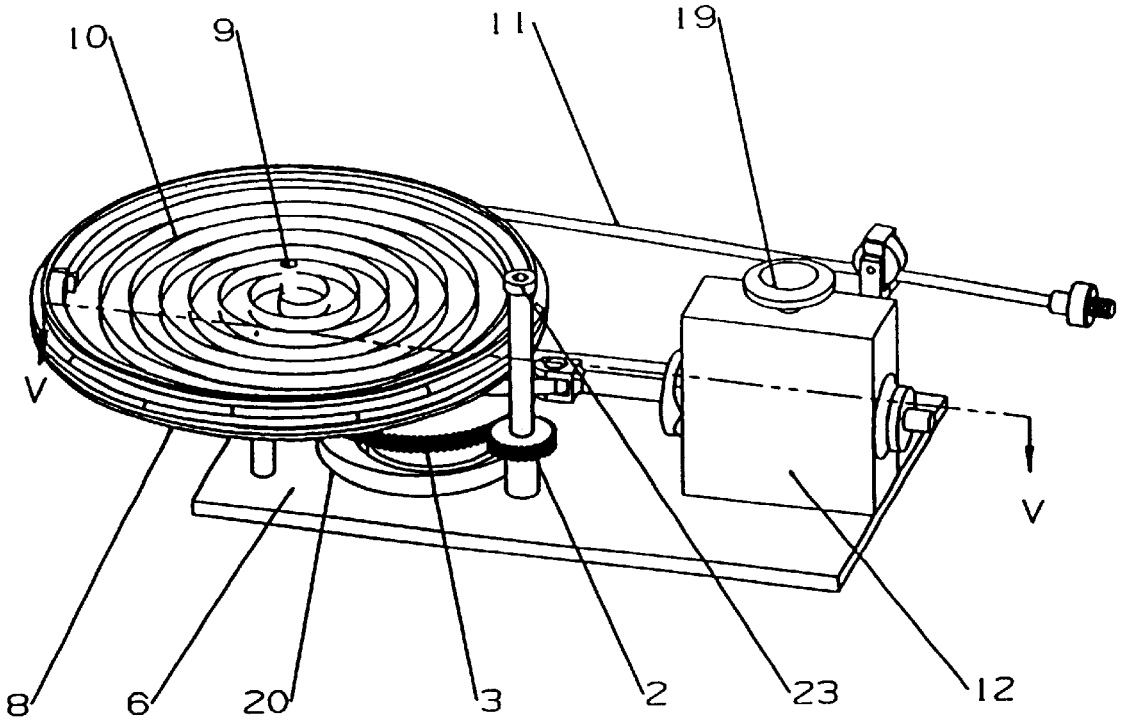
FIG. 7 is a perspective view of a second embodiment of the resistance device according to the present invention.
Figure 8:
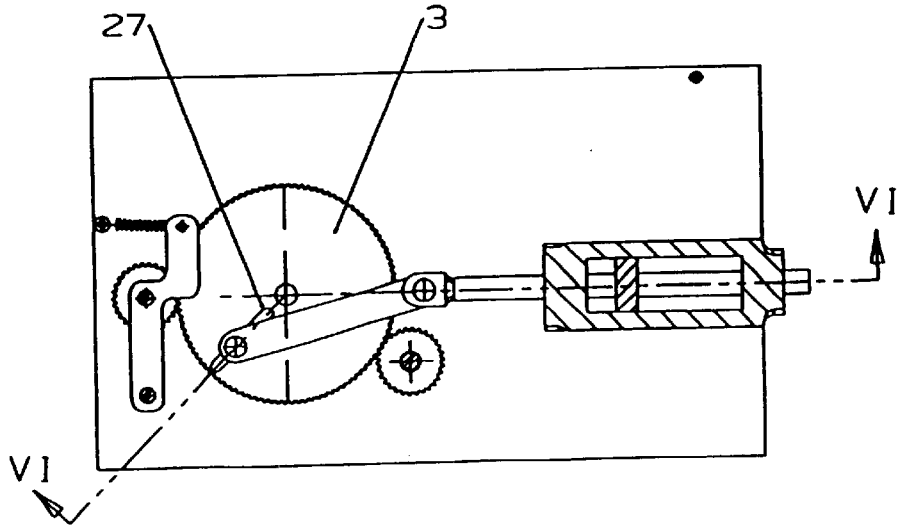
FIG. 8 is a cross-section view of the second embodiment along line V—V of FIG. 7.
Figure 9:
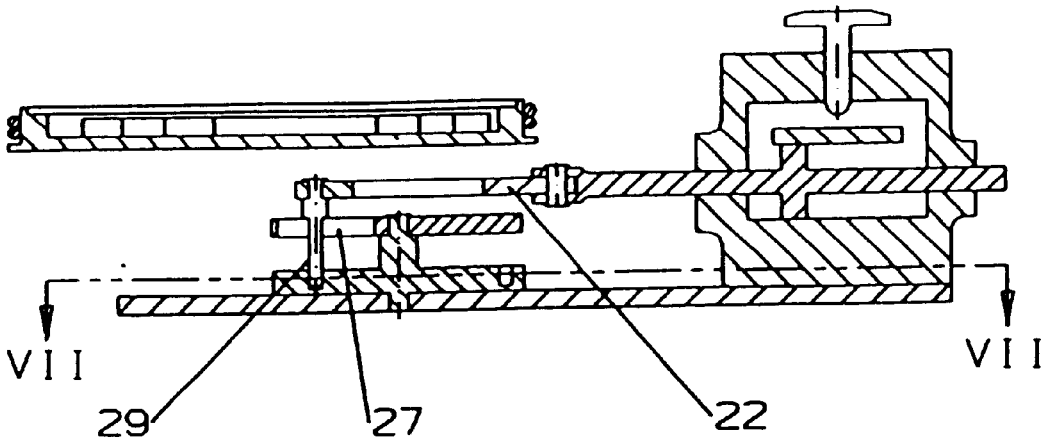
FIG. 9 is a cross section view of the second embodiment along line VI—VI of FIG. 8.
Figure 10:
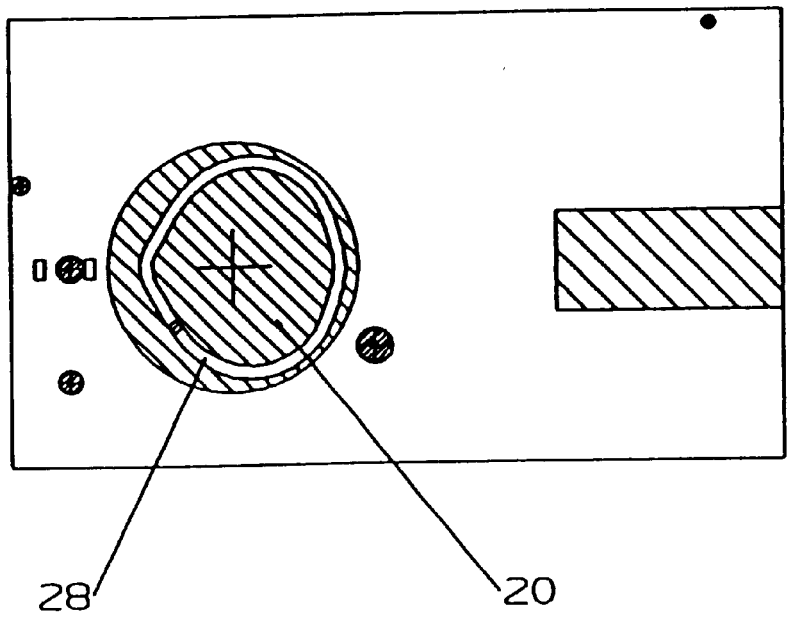
FIG. 10 is a cross section view of the second embodiment along line VII—VII of FIG. 9.
Figure 11:
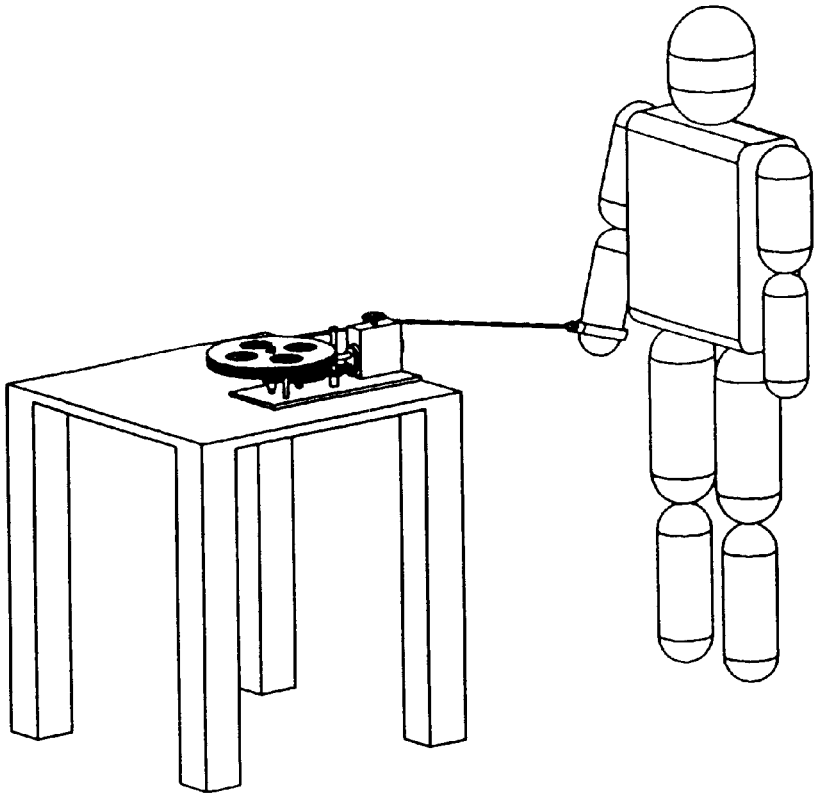
FIGS. 11–21 is illustrations showing how the load device of the present invention can be used in different exercise machines and for various exercise routines.
Figure 12:
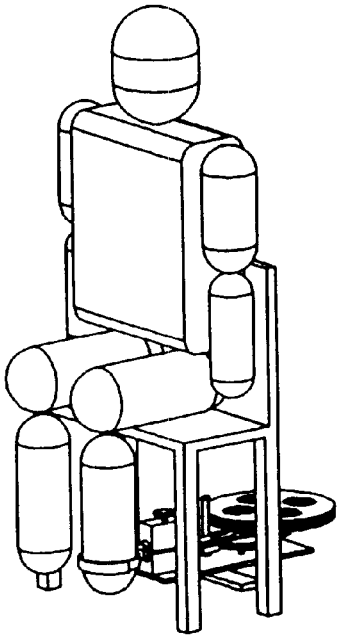
Figure 13:
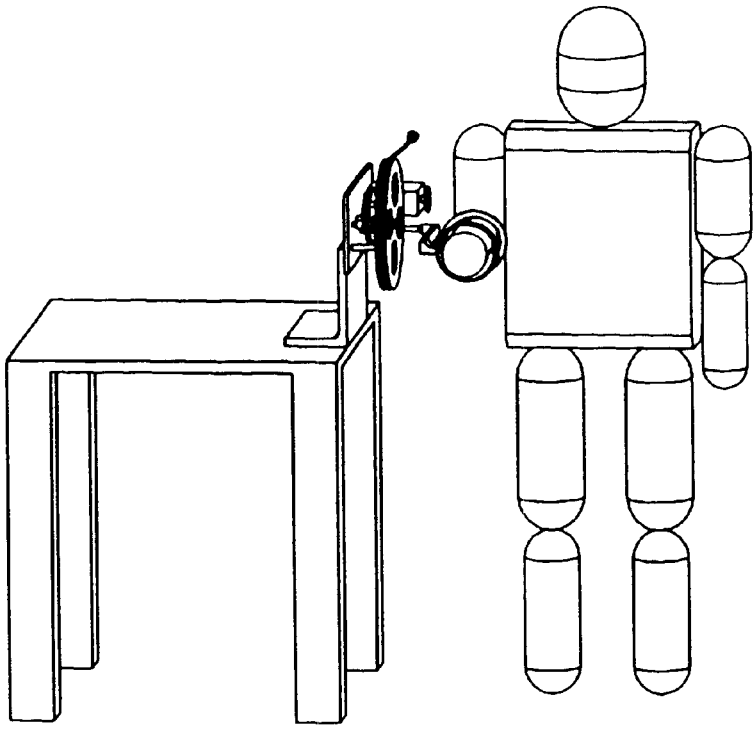
Figure 14:
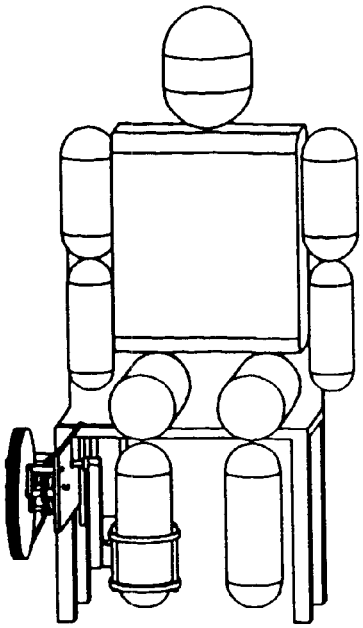
Figure 15:
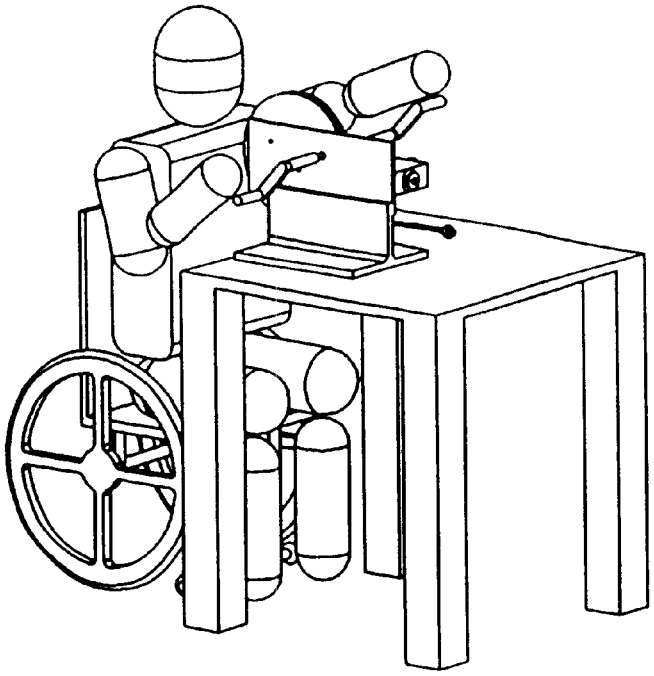
Figure 16:
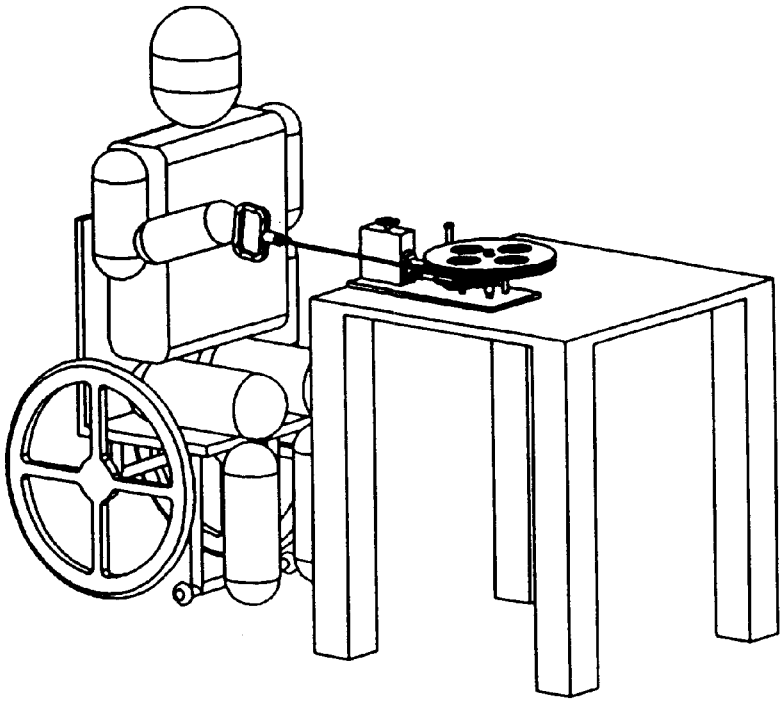
Figure 17:
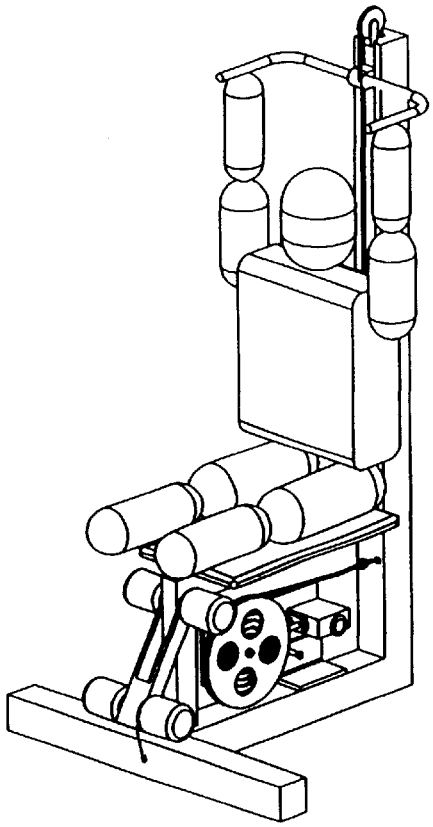
Figure 18:
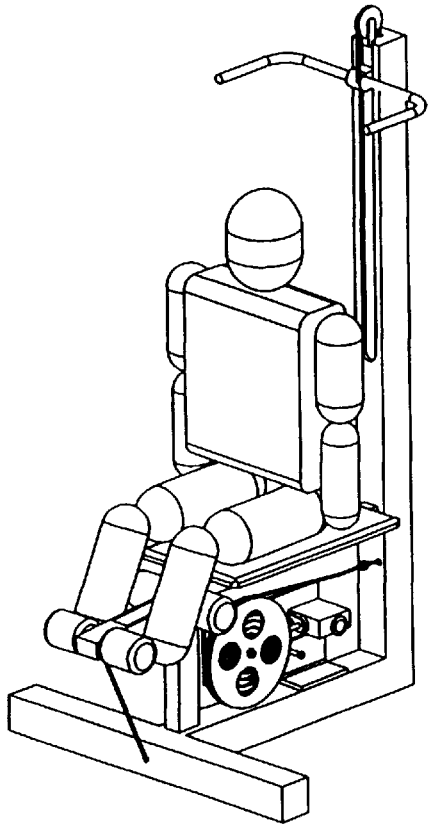
Figure 19:
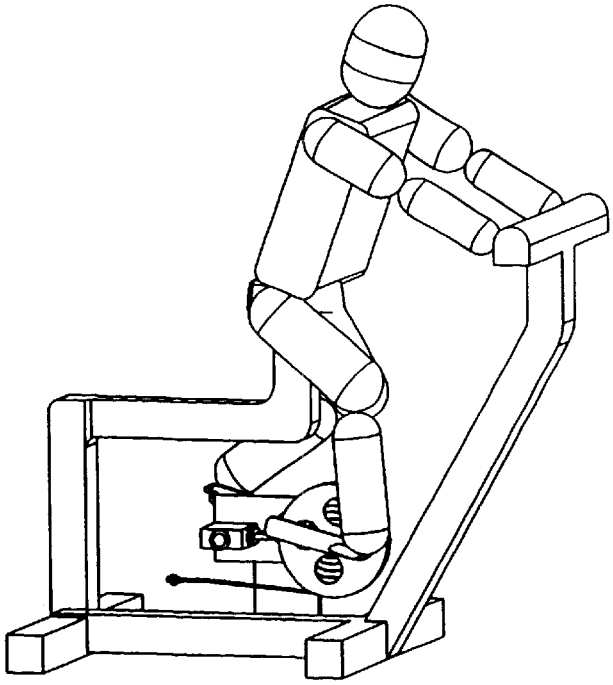
Figure 20:
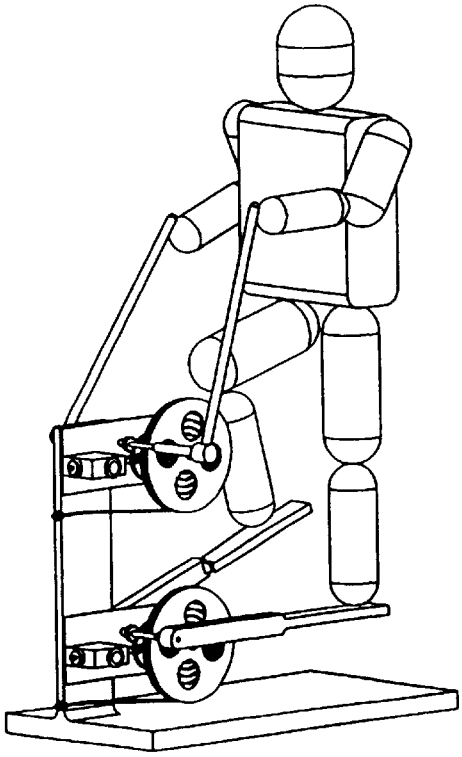
Figure 21:
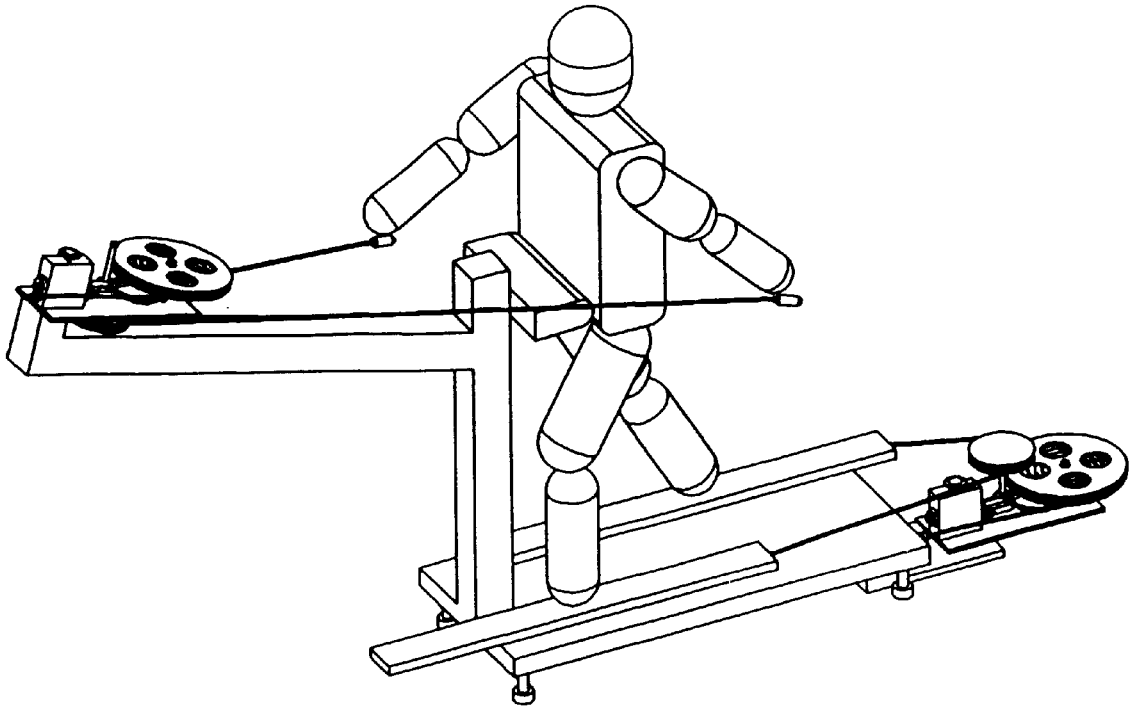

One end of connecting rod 22 is jointed to the member 3 and a second end of the connecting rod 22 is jointed to the piston 1S (see FIG. 3). A cross-section area of the first channel 13 can be adjusted by a first valve 16 that is manually operated (see FIG. 2). To manually adjust the first valve 16 for an original magnitude of the exercise load, a handle 19 is provided. If the cross-section area of the channel 13 is smaller, then the resistance force against motion of the piston 15 in the cylinder 12 is higher A cross-section area of the second channel 14 is adjusted by a second valve 17 that is operated by a pusher 18. The pusher 18 is permanently engaged with a cam 20 by means of a compression spring 21. The cam 20 is coaxial with and secured to the driven member 3. Thus, the structure comprising the cam 20, the pusher 18, the spring 21, and the valve 17 in the channel 14 is the correction means.

In pulling operation, a person pulls the free end of the cable 11. As the exercise load is applied, the arm 4 is rotated around the fulcrum 5 (in clockwise direction according to FIG. 3), and the driving member 1 is moved into engaged position with the driven member 3. The combined force of the recoil spring 10 and the spring 7 is substantially less than the resistance force of the piston 15 even if the cross-section areas in channels 13 and 14 are maximum. Thus, when the exercise load is applied, the driving member 1 is always engaged with the driven member 3. The driving member 1 is rotated, and the cable 11 is unwound from the drum 8. Rotating the driving member 1 forces driven member 3 to revolve with the cam 20. This rotation is transformed into reciprocal motion of the piston 15 by means of the connecting rod 22. Because the cam 20 is also rotated, the pusher 18 is also involved in reciprocal motion. In the rotation process of the driven member 3, an angle between the connecting rod 22 longitudinal axis and the piston 15 stroke direction is varied. Without the correction means, this angle variation would cause a variable exercise load although the cross-section area of the first channel 13 and, respectively, the resistance force of the piston 15 are constant. This happens because a distance between an axis that joints the connecting rod 22 with the member 3 and the axis of the member 3 is not changed during the member 3 rotation To maintain a constant exercise load magnitude, the cam 20 is shaped and secured to the driven member 3 in relation to a position of the connecting rod 22 so that when the mentioned angle is larger, the valve 17 is more open. In that case, the resistance force of the piston 15 is changed. Although the resistance force of the piston 15 is variable, the exercise load is always the same (with any given cross-section area in the channel 13 that is set manually). Also, contemporary physical therapy, rehabilitation, and fitness programs demand that the exercise load be altered according to a predetermined curve during an exercise cycle. In that case, the cam 20 is shaped according to these requirements. So, the correction means allows applying a different pattern of exercise loads, e.g., either the constant exercise load magnitude or the predetermined variable exercise load. When the person releases the cable 11, spring 7 disengages the member 1 from the member 3, and the cable 11 is wound on the drum 8 by means of the recoil spring 10.

In rotation operation, the person revolves the shaft 23 by rotation exercise accessory handles. The movable driving member 1 stays in disengaging position with the driven member 3. Rotation of the shaft 23 is transmitted to the immovable diving member 2. Because the member 2 is permanently engaged with the driven member 3, the member 3 is rotated, and the resistance means with the correction means acts the same as in pulling operation. The shaft 23 rotation can be in either clockwise direction or counter-clockwise direction. If the person discontinues to revolve the shaft 23, the member 3 and the resistance means are quickly stopped without any inertia.

Referring to FIGS. 7–10 wherein a second embodiment of the resistance device of the present invention is shown. In this embodiment, the driven member 3 comprises a radial slot 27, is not secured to the cam 20, and can be rotated relative to the cam 20. The cam 20 in that embodiment is secured to the frame 6 and has a guided slot 28 (see FIG. 10). A profile of the guided slot 28 is based on the principals that were mentioned above. A finger 29 going through the radial slot 27 and is secured to the connecting rod 22 (see FIG. 9). The free end of the finger 29 is disposed into the guided slot 28. The pusher 18, the valve 17, and the second channel 14 are not used in this embodiment.

During rotation of the driven member 3, the finger 29 slides along the slot 27 and follows the profile of the guided slot 28. Thus, the distance between the axis that joints the connecting rod 22 with the member 3 and the axis of the member 3 is changed according to the profile of the guided slot 28. That alteration maintains either the constant exercise load magnitude or the predetermined variable exercise load. So, the correction of the exercise load in that case is achieved by mechanically without any involvement of additional hydraulic resistance.

Following are only a few of the advantages offered by the proposed resistance device over conventional resistance means for exercise machines. First, the resistance device can provide absolutely exact amount and pattern of load with very compact, inexpensive and very simple means. Second, this device can be easily installed in actually any existing exercise machine and convert them into precise tool for medical research, rehabilitation, therapy, and fitness equipment with predetermined program and exact feedback data from a patient/user. Third, the device can be used as a stand-alone unit with great variety of programs to perform. Fourth, the resistance device does not use electrical and any energy to create the exercise load.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

We claim:

1. A high precision resistance device for an exercise machine comprising;

(a) a movable axis driving member;

(b) an immovable axis driving member;

(c) a driven member permanently engaged with said immovable axis driving member;

(d) a means to engage said movable axis driving member with said driven member;

(e) a first cable, a second cable, and a plurality of levers;

(f) a first drum to store said first cable; said first drum is coaxial with and connected to said movable axis driving member;

(g) a second drum; said second drum having a surface to be engaged with said second cable;

(h) a shaft to permanently receive said immovable axis driving member and interchangeably receive either said second drum or at least one of said plurality of levers;

(i) a resistance means to apply force against said driven member rotation; said resistance means further comprising a hydraulic cylinder filled with incompressible fluid and having front and rear ends, a first channel with first valve and first adjustment means of flow section area for said fluid, a second channel with second valve and second adjustment means of flow section area for said fluid, a piston, and a connecting rod to transmit force in either direction between said piston and said driven member;

(j) a correction means to offset said resistance means force instability due to a variable position of said connecting rod and also to offset variable load needs to apply to said plurality of levers due to their variable position during an exercise; said correction means further comprising a cam coaxial with and connected to said driven member, and permanently engaged with second adjustment means of said second valve in said second channel.

2. The resistance device of claim 1, wherein both said first channel and said second channel connect said front end to said rear end of said hydraulic cylinder, and both said first valve and said second valve are adapted so that the cross section of said channels can be varied.

3. The resistance device of claim 1, wherein said first adjustment means is a handle to manually adjust said first valve, and said second adjustment means is a pusher with two ends one of which is permanently engaged with said cam and another one which is engaged with said second valve.

4. The resistance device of claim 3, wherein said second valve is a portion of said pusher.

5. The resistance device of claim 1, wherein said connecting rod has a longitudinal axis, said cam of said correction means is shaped and secured to said driven member in relation to a position of said connecting rod so that the larger the deviation of said connecting rod longitudinal axis from said piston stroke direction the more open the flow section area in said second channel in a proportion wherein a resistance against rotation of said driven member is always the same with any given flow section area set by said first valve in said first channel.

6. The resistance device of claim 1, wherein said cam of said correction means is secured to said driven member in an interchangeable manner and is shaped so that when said levers are used the resistance force against their rotation is predetermined with any angle of said levers turn.

7. The resistance device of claim 1, wherein said means to engage said movable axis driving member with said driven member having an arm with said first drum and a spring element on one end of said arm, a fulcrum on its other end and said movable axis driving member in between said two ends of said arm, and said first drum having an internal cavity containing a recoil spring so that when said first cable is unwound from said first drum, said recoil spring and said spring element combined force is substantially less than the force of the resistance of said resistance means, provided that said spring element force is applied in a direction opposite to a force applied to unwind said first cable from said first drum.

8. The resistance device of claim 1, wherein said shaft having two free ends each adapted to receive and lock-in any lever out of said plurality of levers or said second drum.

9. The resistance device of claim 1, wherein said plurality of levers includes two levers with pedals for a stationary bicycle exercise, one said lever having a stop bar for a knee extension/flexion and tibial rotation therapy, said second lever having a bracket for special pathologies such as anti-shear and sliding ankle cuff.

10. The resistance device of claim 1, wherein said first cable having one free end, said second cable having two free ends, and each said free end of each cable is adapted to receive and lock-in a handle/bracket for shoulder abduction/adduction, internal/external rotation, diagonal patterns, elbow extension/flexion and other rehabilitative exercises.

* * * * *